US011145481B1

(12) United States Patent
Hattori et al.

(10) Patent No.: US 11,145,481 B1
(45) Date of Patent: Oct. 12, 2021

(54) X-RAY GENERATION USING ELECTRON BEAM

(71) Applicant: HAMAMATSU PHOTONICS K.K., Hamamatsu (JP)

(72) Inventors: Shinya Hattori, Hamamatsu (JP); Ryosuke Yabushita, Hamamatsu (JP); Naofumi Kosugi, Hamamatsu (JP)

( * ) Notice: Subject to any disclaimer, the term of this patent is extended or adjusted under 35 U.S.C. 154(b) by 0 days.

(21) Appl. No.: 16/846,401

(22) Filed: Apr. 13, 2020

(51) Int. Cl.
*H01J 35/06* (2006.01)
*H01J 35/14* (2006.01)

(52) U.S. Cl.
CPC ..... *H01J 35/066* (2019.05); *H01J 35/064* (2019.05); *H01J 35/14* (2013.01)

(58) Field of Classification Search
CPC ..... H01J 35/066; H01J 35/14; H01J 35/147; H01J 35/153
See application file for complete search history.

(56) References Cited

U.S. PATENT DOCUMENTS 4,130,759 A * 12/1978 Haimson ..... A61B 6/4028 378/10
5,812,632 A * 9/1998 Schardt ..... H01J 35/14 378/137
6,778,633 B1 * 8/2004 Loxley ..... H01J 35/147 378/113
2009/0279667 A1 11/2009 Rogers et al.
2010/0080359 A1 4/2010 Sakabe
2013/0336462 A1 12/2013 Suzuki et al.
2014/0029729 A1 1/2014 Kucharczyk
2014/0029730 A1 * 1/2014 Kucharczyk ..... H01J 35/066 378/125
2015/0187536 A1 7/2015 Canfield et al.
2016/0268095 A1 9/2016 Canfield et al.
2016/0336140 A1 * 11/2016 Nonoguchi ..... H01J 35/147
2018/0144902 A1 5/2018 Lemaitre
(Continued)

FOREIGN PATENT DOCUMENTS

JP H11-144653 5/1999
JP 2002-343289 11/2002
JP 2006-164819 6/2006
(Continued)

OTHER PUBLICATIONS

SOEI Patent and Law Firm, SOEI Statement of Related Matters, dated Jun. 17, 2020.
(Continued)

*Primary Examiner* — Chih-Cheng Kao
(74) *Attorney, Agent, or Firm* — Soei Patent & Law Firm

(57) ABSTRACT

An X-ray generation apparatus includes an electron gun emitting an electron beam having a circular cross-sectional shape, a magnetic focusing lens located downstream of the electron gun and focusing the electron beam while rotating the electron beam around an axis along a first direction, a magnetic quadrupole lens located downstream of the magnetic focusing lens and deforming the cross-sectional shape of the electron beam into an elliptical shape having a major axis along a second direction orthogonal to the first direction and a minor axis along a third direction orthogonal to the first direction and the second direction, and a target located downstream of the magnetic quadrupole lens and emitting an X-ray in response to incidence of the electron beam.

20 Claims, 8 Drawing Sheets

(56) References Cited

U.S. PATENT DOCUMENTS

2018/0192981 A1* 7/2018 Wang ..... A61B 6/4028

FOREIGN PATENT DOCUMENTS

| | | |
|---|---|---|
| JP | 5248254 | 7/2013 |
| JP | 2014-026964 | 2/2014 |
| JP | 2015-041585 | 3/2015 |
| JP | 2017-022054 | 1/2017 |
| JP | 2018-106899 | 7/2018 |
| JP | 6527239 | 6/2019 |
| WO | 00/058991 | 10/2000 |
| WO | 2018/066135 | 4/2018 |

OTHER PUBLICATIONS

International Search Report dated Apr. 27, 2021 for PCT/JP2021/005317(with English partial translation).
International Search Report dated Apr. 20, 2021 for PCT/JP2021/005326(with English partial translation).

* cited by examiner

X-RAY GENERATION USING ELECTRON BEAM

TECHNICAL FIELD

An aspect of the present disclosure relates to an X-ray generation apparatus.

BACKGROUND

Known X-ray devices may generate an X-ray by causing an electron beam emitted from a cathode to be incident on a target. For example, Japanese Unexamined Patent Application Publication No. 2006-164819 describes a reflective target having an electron incident surface inclined with respect to the traveling direction of an electron beam. Additionally, Japanese Patent No. 6527239 describes adjusting a cross-sectional shape of an electron beam.

SUMMARY

In some X-ray devices, the focal point (effective focal point) of the extracted X-ray is not the shape of the electron beam incident on the target (that is, the shape of the electron beam viewed from the direction of incidence) but a projected shape viewed from the extraction direction (X-ray emission direction). In addition, the longitudinal and lateral dimensions of the effective focal point match each other (that is, the shape of the effective focal point is a substantially circular shape) for an image having the same resolution in the longitudinal and lateral directions to be obtained in an inspection using X-rays or the like. An elliptical beam cross section of the electron beam incident on the target may be used as a method for achieving a substantially circular effective focal point.

An inadvertent change in the cross-sectional shape of the electron beam may be attributable to, for example, the deterioration of one or mom components of the X-ray device. However, if the cross-sectional shape of the electron beam is determined by the opening shape of the grid electrode, this may prohibit the ability to change or correct a shape formed by the X-ray device, such as the aspect ratio between the major axis and the minor axis of an elliptical shape.

Additionally, for certain types of X-ray devices which use two quadrupole cores for adjusting a cross-sectional shape of an electron beam, it can be difficult to simultaneously adjust both the aspect ratio of the cross-sectional shape of the electron beam and the size of the electron beam, such as by combining the two quadrupole cores.

Disclosed herein are example X-ray generation apparatuses with which the aspect ratio and size of a cross-sectional shape of an electron beam can be readily and flexibly adjusted.

An example X-ray generation apparatus includes an electron gun configured to emit an electron beam having a circular cross-sectional shape, a magnetic focusing lens located downstream of the electron gun and configured to focus the electron beam while rotating the electron beam around an axis (rotational axis) along a first direction. Additionally, the X-ray generation apparatus may include a magnetic quadrupole lens located downstream of the magnetic focusing lens and configured to deform the circular cross-sectional shape of the electron beam into an elliptical cross-sectional shape having a major axis along a second direction orthogonal to the first direction and a minor axis along a third direction that is orthogonal to both the first direction and the second direction. Still further, the X-ray generation apparatus may include a target located downstream of the magnetic quadrupole lens and configured to emit an X-ray in response to an incidence of the electron beam on the target.

In some examples, the size of the electron beam is adjusted by the magnetic focusing lens located downstream of the electron gun and the cross-sectional shape of the electron beam is deformed into an elliptical shape by the magnetic quadrupole lens located downstream of the magnetic focusing lens. Accordingly, the size of the electron beam and the cross-sectional shape can be adjusted independently of each other. In addition, although the electron beam passing through the magnetic focusing lens rotates around an axis along the first direction, the cross-sectional shape of the electron beam reaching the magnetic quadrupole lens through the magnetic focusing lens is constant (circular) regardless of the amount of rotation of the electron beam in the magnetic focusing lens since the cross-sectional shape of the electron beam emitted by the electron gun is circular. The cross-sectional shape of the electron beam in the magnetic quadrupole lens can therefore be consistently and reliably formed into an elliptical shape having a major axis along the second direction and a minor axis along the third direction. As a result, the size and the aspect ratio of the cross-sectional shape of the electron beam may be readily and flexibly adjusted.

The target may have an electron incident surface on which the electron beam is incident. The electron incident surface may be inclined with respect to the first direction and the second direction. A ratio between the major and minor axes of the electron beam subsequent to the deformation into the elliptical cross-sectional shape by the magnetic quadrupole lens, and an inclination angle of the electron incident surface with respect to the first direction and the second direction, determine a focal shape of the X-ray, when viewed from an extraction direction of the X-ray, that is substantially circular. Accordingly, the shape of the focal point (effective focal point) of the extracted X-ray can be made substantially circular by adjusting the forming condition of the magnetic quadrupole lens (aspect ratio) and the inclination angle of the electron incident surface of the target. As a result, an appropriate inspection image may be obtained during, for example, an X-ray inspection using the X-ray generated by the X-ray generation apparatus.

A length of the magnetic focusing lens along the first direction may exceed a length of the magnetic quadrupole lens along the first direction. In some examples, the number of turns of a coil of the magnetic focusing les may be reliably ensured in order to effectively focus the electron beam by generating a relatively large magnetic field in the magnetic focusing lens. Accordingly, the reduction ratio may be increased. Further, the distance from the electron gun to the center of the lens constituted by the magnetic focusing lens may be increased in order to reduce the size of the electron beam incident on the electron incident surface of the target.

An inner diameter of a pole piece of the magnetic focusing lens may exceed an inner diameter of the magnetic quadrupole lens. In some examples, the spherical aberration of the lens constituted by the magnetic focusing lens may be reduced by making the inner diameter of the pole piece of the magnetic focusing lens relatively large. In addition, the number of turns of a coil in the magnetic quadrupole lens may be reduced, and the amount of electric current flowing through the coil may be reduced, by making the inner diameter of the magnetic quadrupole lens relatively small.

As a result, the amount of beat generation in the magnetic quadrupole lens can be reduced.

The X-ray generation apparatus may further include a tubular portion extending along the first direction and forming an electron passage through which the electron beam passes. The magnetic focusing lens and the magnetic quadrupole lens may be directly or indirectly connected to the tubular portion. In some examples, the magnetic focusing lens and the magnetic quadrupole lens can be disposed or attached with respect to the tubular portion as a reference, and thus the central axes of the magnetic focusing lens and the magnetic quadrupole lens can be coaxially disposed with high precision. As a result, a distortion of the profile (cross-sectional shape) of the electron beam which may have otherwise occurred subsequent to passage through the magnetic focusing lens and the magnetic quadrupole lens may be forestalled or prevented.

Additionally, the X-ray generation apparatus may further include a deflection coil configured to adjust a traveling direction of the electron beam. In some examples, the deflection coil may be configured to correct an angular deviation between the emission axis of the electron beam emitted from the electron gun and the central axis of the magnetic focusing lens and the magnetic quadrupole lens. For example, the angular deviation may occur in a case where the emission axis and the central axis intersect with each other at a predetermined angle. Accordingly, the angular deviation may be eliminated by changing the traveling direction of the electron beam to a direction along the central axis by means of the deflection coil.

The deflection coil may be located between the electron gun and the magnetic focusing lens. In some examples, the traveling direction of the electron beam may be preferentially adjusted before the electron beam passes through the magnetic focusing lens and the magnetic quadrupole lens. As a result, the cross-sectional shape of the electron beam incident on the target may be reliably maintained as an intended elliptical shape.

Accordingly, the example X-ray generation apparatuses disclosed herein may be configured to reliably and flexibly adjust the aspect ratio and size of a cross-sectional shape of an electron beam.

DETAILED DESCRIPTION

In the following description, with reference to the drawings, the same reference numbers are assigned to the same components or to similar components having the same function, and overlapping description is omitted.

Figure 1:
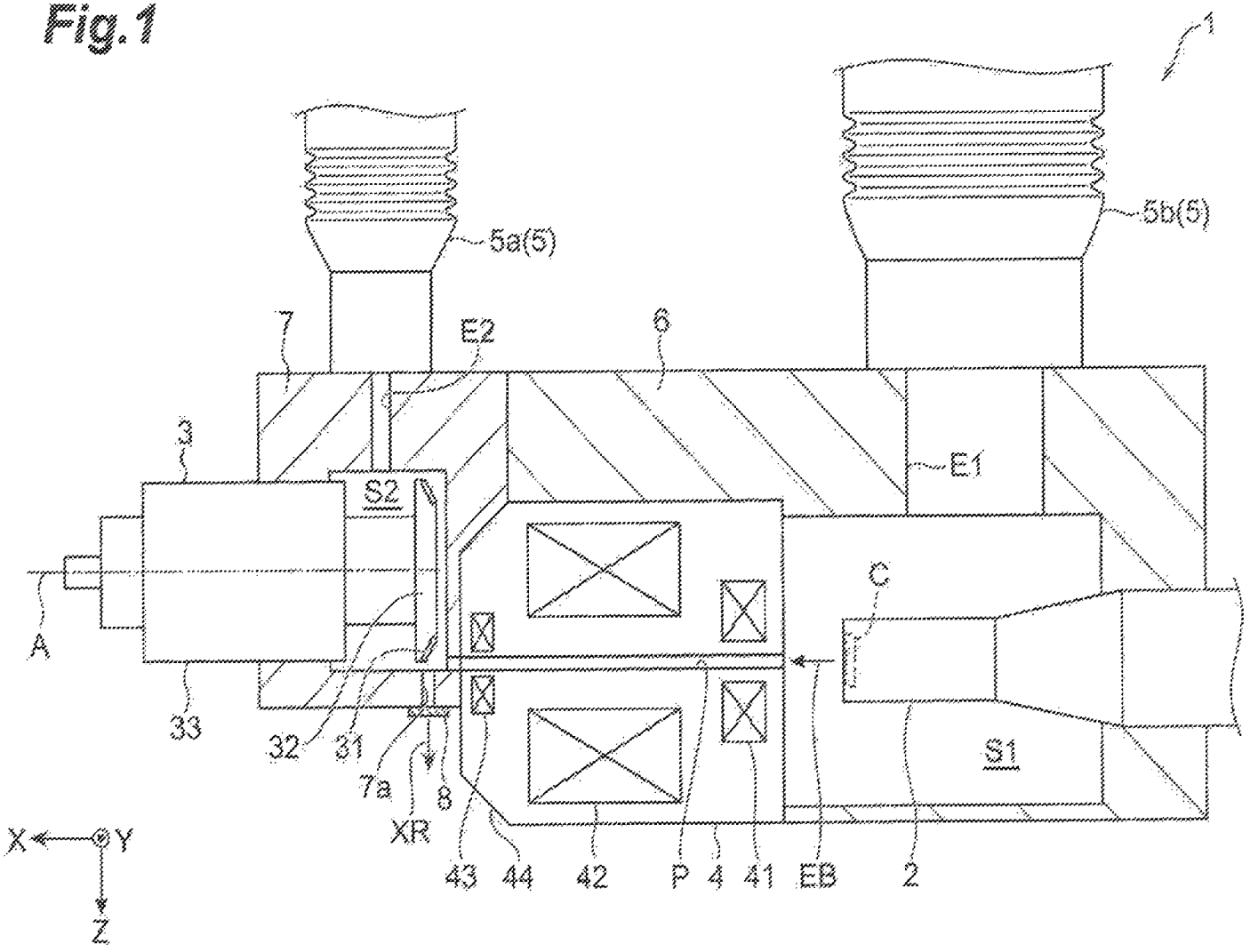
FIG. 1 is a schematic configuration diagram of an example X-ray generation apparatus.

As illustrated in FIG. 1, an example X-ray generation apparatus 1 is provided with an electron gun 2, a rotary anode unit 3, a magnetic lens 4, an exhaust unit 5, a housing 6 (first housing) defining an internal space S1 accommodating the electron gun 2, and a housing 7 (second housing) defining an internal space S2 accommodating the rotary anode unit 3. The housing 6 and the housing 7 may be configured to be detachable from each other, may be integrally coupled so as not to be detachable from each other, or may be integrally formed from the beginning.

The electron gun 2 emits an electron beam EB. The electron gun 2 has a cathode C emitting the electron beam EB. The cathode C is a circular flat cathode emitting the electron beam EB having a circular cross-sectional shape. The cross-sectional shape of the electron beam EB is taken in a direction perpendicular to an X-axis direction (first direction), which is parallel to the traveling direction of the electron beam EB that will be described in additional detail later. Accordingly, the cross-sectional shape of the electron beam EB may be understood to be taken on a YZ plane. The electron emission surface of the cathode C itself may have, for example, a circular shape when viewed from a position facing the electron emission surface of the cathode C (when the electron emission surface of the cathode C is viewed from the X-axis direction) so as to form the electron beam EB having the circular cross-sectional shape.

The rotary anode unit 3 has a target 31, a rotary support body 32, and a drive unit 33 that drives the rotary support body 32 to rotate around a rotation axis A. The target 31 is provided along the peripheral edge portion of the rotary support body 32 formed in a flat truncated cone shape. The rotation axis A is a central axis of the rotary support body 32, such that the side surface of the truncated cone-shaped rotary support body 32 has a surface inclined with respect to the rotation axis A. Additionally, the rotary support body 32 may be formed in an annular shape having the rotation axis A as a central axis. The material that constitutes the target 31 may comprise, for example, a heavy metal such as tungsten, silver, rhodium, molybdenum, or an alloy thereof. The rotary support body 32 is rotatable around the rotation axis A. The material that constitutes the rotary support body 32 may comprise, for example, a metal such as copper or a copper alloy. The drive unit 33 has a drive source, such as a motor, that drives the rotary support body 32 to rotate around the rotation axis A. The target 31 receives the electron beam EB while rotating with the rotation of the rotary support body 32. An X-ray XR is generated as a result. The X-ray XR is emitted outside of the housing 7 from an X-ray passage hole 7*a* formed in the housing 7. A window member 8 forms an air-tight seal at the X-ray passage hole 7*a*. The axial direction of the rotation axis A is parallel to the incident direction of the electron beam EB on the target 31. Alternatively, the rotation axis A may be inclined with respect to the incident direction of the electron beam EB on the target 31 so that the rotation axis A may extend in a direction intersecting with the incident direction. The target 31, which may comprise a reflective target, emits the X-ray XR in a direction intersecting with the traveling direction of the electron beam EB (direction of incidence on the target 31). In some examples, the emission direction of the X-ray XR is orthogonal to the traveling direction of the electron beam EB. Accordingly, it may be understood that the X-axis direction (first direction) is parallel to the traveling direction of the electron beam EB, a Z-axis direction (second direction) is-parallel to the emission direction of the X-ray XR from the target 31, and a Y-axis direction (third direction) is orthogonal to the X-axis direction and the Z-axis direction.

Figure 2:
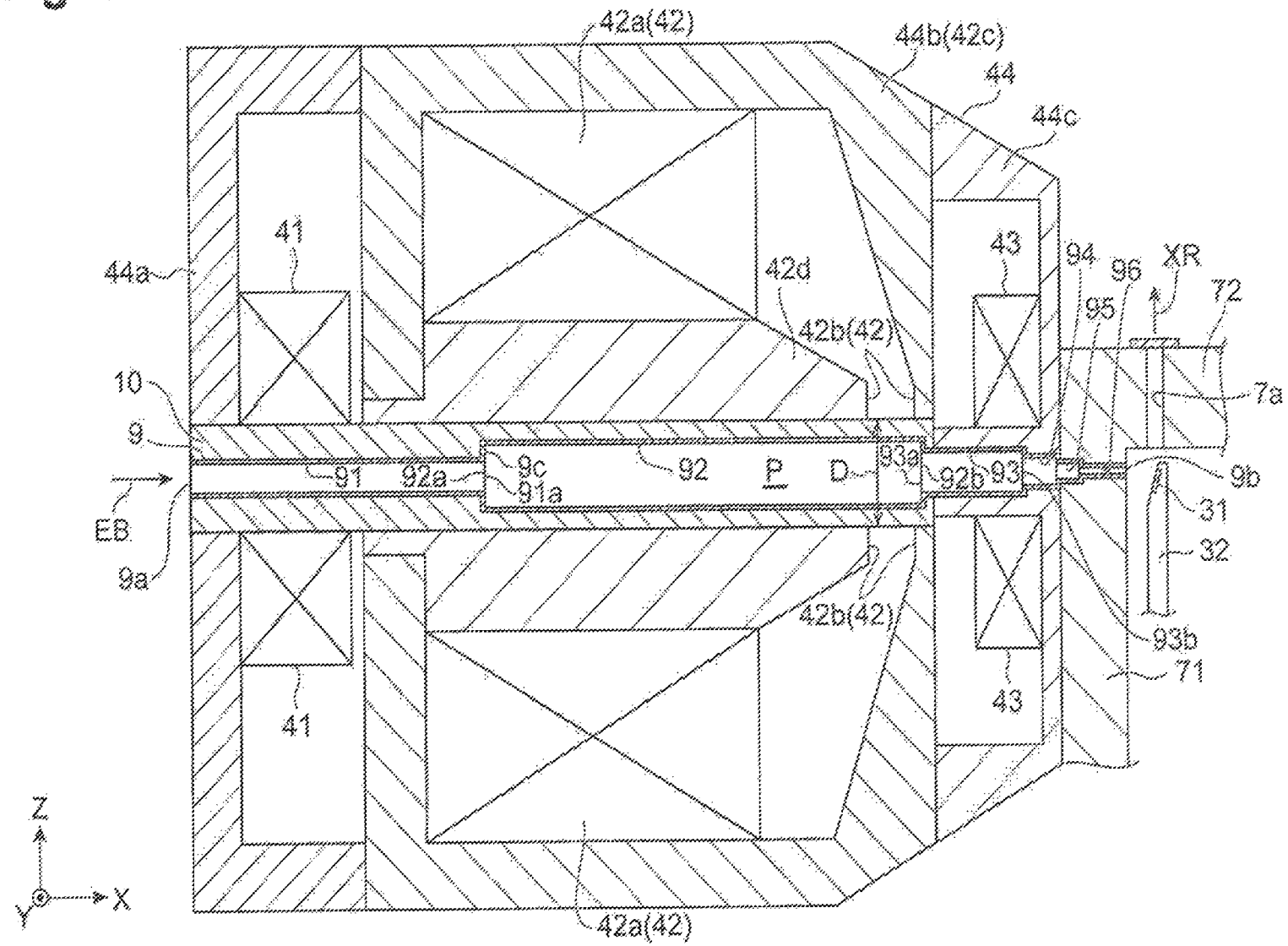
FIG. 2 is a schematic cross-sectional view illustrating an example configuration of a magnetic lens of the X-ray generation apparatus.

The magnetic lens 4 controls the electron beam EB. The magnetic lens 4 has a deflection coil 41, a magnetic focusing lens 42, a magnetic quadrupole lens 43, and a housing 44. The housing 44 accommodates the deflection coil 41, the magnetic focusing lens 42, and the magnetic quadrupole lens 43. The deflection coil 41, the magnetic focusing lens 42, and the magnetic quadrupole lens 43 are located within the housing 44, in this order, from a direction of the electron gun 2 toward the target 31 along the X-axis. An electron passage P through which the electron beam EB passes is formed between the electron gun 2 and the target 31. As illustrated in FIG. 2, the electron passage P may be formed by a cylindrical tube 9 (tubular portion). The cylindrical tube 9 is a nonmagnetic metal member extending along the X-axis direction between the electron gun 2 and the target 31. Additional example configurations of the cylindrical tube 9 will be described in further detail later.

The deflection coil 41, the magnetic focusing lens 42, and the magnetic quadrupole lens 43 are directly or indirectly connected to the cylindrical tube 9. For example, the central axis of the deflection coil 41, the central axis of the magnetic focusing lens 42, and the central axis of the magnetic quadrupole lens 43 are coaxially disposed with high precision by the deflection coil 41, the magnetic focusing lens 42, and the magnetic quadrupole lens 43 being assembled with respect to the cylindrical tube 9 as a reference. Accordingly, the central axis of the deflection coil 41, the central axis of the magnetic focusing lens 42, and the central axis of the magnetic quadrupole lens 43 coincide with the central axis of the cylindrical tube 9 (axis parallel to the X axis).

The deflection coil 41 is located between the electron gun 2 and the magnetic focusing lens 42. The deflection coil 41 is disposed so as to surround the electron passage P. In some examples, the deflection coil 41 is indirectly connected to the cylindrical tube 9 via a tube member 10. The tube member 10 is a nonmagnetic metal member extending coaxially with the cylindrical tube 9. The tube member 10 is provided so as to cover the outer periphery of the cylindrical tube 9. The deflection coil 41 is positioned by the outer peripheral surface of the tube member 10 and the surface of a wall portion 44*a* that is on the target 31 side. The wall portion 44*a*, which is made of a nonmagnetic material, is a part of the housing 44 provided at a position facing the internal space S1. The deflection coil 41 adjusts the traveling direction of the electron beam EB emitted from the electron gun 2. One deflection coil (one set of deflection coils) or two deflection coils (two sets of deflection coils) may constitute the deflection coil 41. In the former case that involves one deflection coil, the deflection coil 41 may be configured to correct an angular deviation between the emission axis of the electron beam EB emitted from the electron gun 2 and the central axis of the magnetic focusing lens 42 and the magnetic quadrupole lens 43 (axis parallel to the X axis). For example, the angular deviation may occur in a case where the emission axis and the central axis intersect with each other at a predetermined angle. Accordingly, the angular deviation may be eliminated by changing the traveling direction of the electron beam EB to a direction along the central axis by means of the deflection coil 41. In the latter case that involves two deflection coils, two-dimensional deflection can be performed by the deflection coil 41 in order to correct not only the angular deviation but also a lateral offset between the emission axis and the central axis (such as when the emission axis and the central axis are parallel to each other in the X-axis direction and separated from each other in one or both of the Y-axis and Z-axis directions).

The magnetic focusing lens 42 is located downstream of the electron gun 2 and the deflection coil 41. The magnetic focusing lens 42 focuses the electron beam EB while rotating the electron beam EB around an axis along the X-axis direction. In some examples, the electron beam EB passing through the magnetic focusing lens 42 is focused while rotating in a spiral shape. The magnetic focusing lens 42 has a pole piece 42*b*, a yoke 42*c*, a yoke 42*d*, and a coil 42*a* disposed so as to surround the electron passage P. The yoke 42*c* also functions as a wall portion 44*b* of the housing 44 provided so as to interconnect the tube member 10 and apart of the outside of the coil 42*a*. The yoke 42*d* is a tubular member provided so as to cover the outer periphery of the tube member 10. In some examples, the coil 42*a* is indirectly connected to the cylindrical tube 9 via the tube member 10 and the yoke 42*d*. The yoke 42*c* and the yoke 42*d* constitute the pole piece 42*b*. The yoke 42*c* and the yoke 42*d* are ferromagnetic bodies such as iron. Additionally, the pole piece 42*b* may be constituted by a notch (gap) provided between the yoke 42*c* and the yoke 42*d*, and a part of the yoke 42*c* and a part of the yoke 42*d* positioned near the notch. An inner diameter D of the pole piece 42*b* is equal to the inner diameter of the region of the yoke 42*c* or the yoke 42*d* that is adjacent to the gap. Accordingly, the magnetic focusing lens 42 may be configured such that the magnetic field of the coil 42*a* leaks from the pole piece 42*b* to the cylindrical tube 9 side.

The magnetic quadrupole lens 43 is located downstream of the magnetic focusing lens 42. The magnetic quadrupole lens 43 deforms the cross-sectional shape of the electron beam EB into an elliptical shape having a major axis along the Z-axis direction and a minor axis along the Y-axis diction. The magnetic quadrupole lens 43 is disposed so as to surround the electron passage P. In some examples, the magnetic quadrupole lens 43 is indirectly connected to the cylindrical tube 9 via a wall portion 44*c* of the housing 44. The wall portion 44*c* is connected to the wall portion 44*b* and is provided so as to cover the outer periphery of the cylindrical tube 9. The wall portion 44*c* is made of a nonmagnetic metal material.

Figure 3:
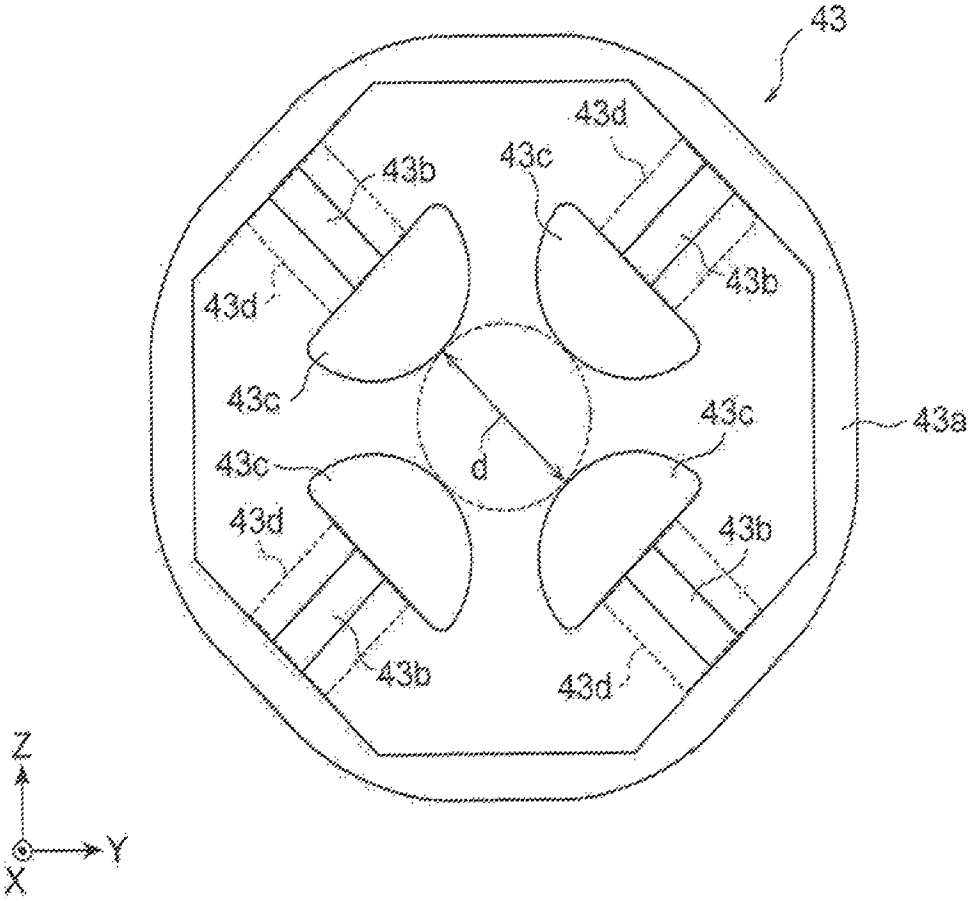
FIG. 3 is a front view of an example magnetic quadrupole lens.

As illustrated in FIG. 3, the example magnetic quadrupole lens 43 has an annular yoke 43*a*, four columnar yokes 43*b* provided on the inner peripheral surface of the yoke 43*a*, and yokes 43*c* respectively provided at the distal ends of the columnar yokes 43*b*. A coil 43*d* is wound around the columnar yoke 43*b*. The yokes 43*c* each have a substantially semicircular cross-sectional shape on the YZ plane. An inner diameter d of the magnetic quadrupole lens 43 is the diameter of an inscribed circle passing through the respective innermost ends of the yokes 43*c*. The magnetic quadrupole lens 43 functions as a concave lens on the XZ plane (plane orthogonal to the Y-axis direction) and functions as a convex lens on the XY plane (plane orthogonal to the Z-axis direction). As a result of this function of the magnetic quadrupole lens 43, the aspect ratio between the diameter (major axis X1) of the electron beam EB along the Z-axis direction and the diameter (minor axis X2) of the electron beam BB along the Y-axis direction is adjusted such that the Z-axis-direction length of the electron beam BB is greater than the Y-axis-direction length of the electron beam EB. Accordingly, the aspect ratio may be selectively modified by adjusting the amount of electric current flowing through the coil 43*d*. As an example, the aspect ratio between the major axis X1 and the minor axis X2 is adjusted to "10:1".

The exhaust unit 5 has a vacuum pump 5*a* (first vacuum pump) and a vacuum pump 5*b* (second vacuum pump). The housing 6 is provided with an exhaust flow path E1 (first exhaust flow path) for evacuating the space in the housing 6 (the internal space S1 defined by the housing 6 and the housing 44 of the magnetic lens 4). The vacuum pump 5*b* and the internal space S1 communicate (e.g., are fluidly coupled) with each other via the exhaust flow path E1. The housing 7 is provided with an exhaust flow path E2 (second exhaust flow path) for evacuating the space in the housing 7 (the internal space S2 defined by the housing 7). The vacuum pump 5*a* and the internal space S2 communicate (e.g., are fluidly coupled) with each other via the exhaust flow path E2. The vacuum pump 5*b* evacuates the internal space S1 via the exhaust flow path E1. The vacuum pump 5*a* evacuates the internal space S2 via the exhaust flow path E2. As a result, the internal space S1 and the internal space S2 are maintained in a vacuumized state or a partial vacuum, for example in order to remove any gas that is generated by the electron gun or at the target, as further described herein. The internal pressure in the internal space S1 may be preferably maintained in a partial vacuum of less than or equal to $10^{-4}$ Pa and may be more preferably maintained in a partial vacuum of less than or equal to $10^{-5}$ Pa. The internal pressure in the internal space S2 may be preferably maintained in a partial vacuum of between $10^{-6}$ Pa and $10^{-3}$ Pa. The internal space of the cylindrical tube 9 (space in the electron passage P) is also evacuated by the exhaust unit 5 via the internal space S1 or the internal space S2.

Figure 8:
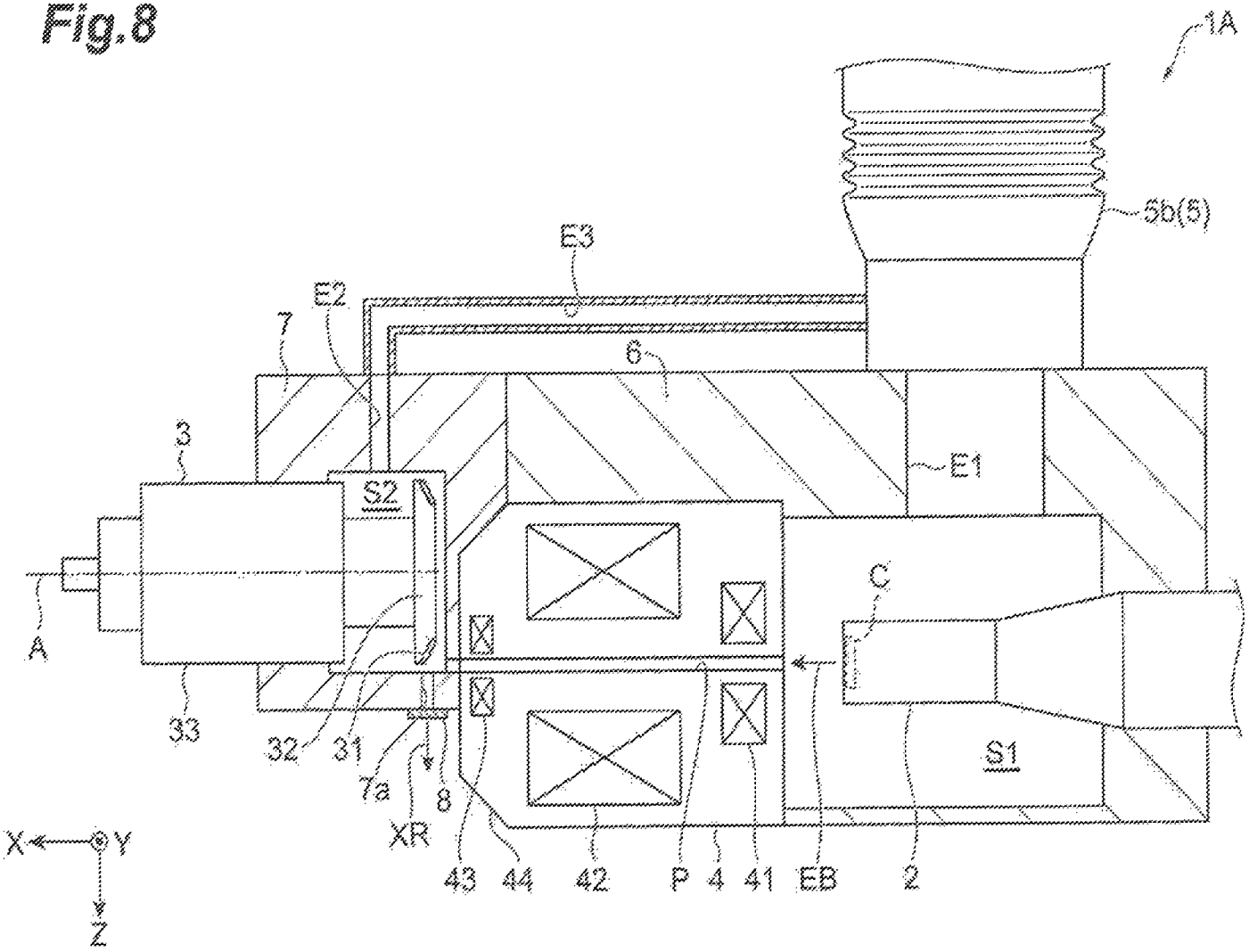
FIG. 8 is a schematic configuration diagram of another example X-ray generation apparatus.

As illustrated in FIG. 8, the use of the two exhaust pumps (vacuum pumps 5*a* and 5*b*) illustrated in FIG. 1 may be replaced with an example structure (X-ray generation apparatus 1A) in which both the internal space S1 and the internal space S2 can be evacuated by means of one exhaust pump (here, the vacuum pump 5*b* as an example). In some examples, the exhaust flow path B1 and the exhaust flow path E2 may be fluidly coupled to each other by means of a communication path E3 located outside the housing 6 and the housing 7. In other examples, the communication path B3 may comprise a through hole continuously provided from the inside of the wall portion of the housing 7 to the inside of the wall portion of the housing 6 so as to fluidly couple the exhaust flow path E1 and the exhaust flow path E2 to each other. Although either the vacuum pump 5*a* or the vacuum pump 5*b* may be used as the single exhaust pump, more efficient evacuation can be performed by the vacuum pump 5*b* fluidly coupled to the exhaust flow path E1 being used as the exhaust pump.

In some examples, a voltage is applied to the electron gun 2 in a state where the internal spaces S1 and S2 and the electron passage P are auctioned by the exhaust system. As a result, the electron beam B having the circular cross-sectional shape is emitted from the electron gun 2. The electron beam EB is focused on the target 31 and deformed so as to have an elliptical cross-sectional shape by the magnetic lens 4, and the electron beam EB is incident on the rotating target 31. When the electron beam EB is incident on the target 31, the X-ray XR is generated at the target 31 and the X-ray XR having a substantially circular effective focal point shape is emitted outside the housing 7 from the X-ray passage hole 7*a*.

As illustrated in FIG. 2, an example configuration of the cylindrical tube 9 has a shape in which the size of the diameter of the cylindrical tube 9 changes in stages along the X-axis direction. For example, the cylindrical tube 9 has six cylindrical portions 91 to 96 located along the X-axis direction. Each of the cylindrical portions 91 to 96 has a constant diameter along the X-axis direction. In some examples, the outer diameter of the cylindrical tube 9 may not change in synchronization with the inner diameter of the cylindrical tube 9. Accordingly, the outer diameter of the cylindrical tube 9 may be constant.

The cylindrical portion 91 (e.g., a first cylindrical portion) includes a first end portion 9*a* of the cylindrical tube 9, which is on the electron gun 2 side of the cylindrical portion 91. The cylindrical portion 91 extends from the first end portion 9*a* to a second end portion 91*a* surrounded by a portion of the coil 42*a* on the electron gun 2 side of the cylindrical portion 91 at a boundary part 9*c*. A first end portion 92*a* of the cylindrical portion 92 (e.g., a second cylindrical portion) is connected to the second end portion 91*a* of the cylindrical portion 91 on the target 31 side of the cylindrical portion 91. In some examples, the cylindrical portion 92 extends from the second end portion 91*a* of the cylindrical portion 91 to a second end portion 92*b* of the cylindrical portion 92 which is slightly closer to the target 31 than the pole piece 42*b*. For example, the second end portion 92*b* of the cylindrical portion 92 may be located between the pole piece 42*b* and the target 31 along the X-axis direction. Additionally, a first end portion 93*a* of the cylindrical portion 93 (e.g., a third cylindrical portion) is connected to the second end portion 92*b* of the cylindrical portion 92 on the target 31 side of the cylindrical portion 92.

The cylindrical portion 93 extends from the second end portion 92*b* of the cylindrical portion 92 to a second end portion 93*b* of the cylindrical portion 93 which is surrounded by the magnetic quadrupole lens 43. A first end of the cylindrical portion 94 (e.g., a fourth cylindrical portion) is connected to the second end portion 93*b* of the cylindrical portion 93 on the target 31 side of the cylindrical portion 93. The cylindrical portion 94 extends from the second end portion 93*b* of the cylindrical portion 93 to a housing side 7 of the wall portion 44*c*.

The cylindrical portion 95 (e.g., a fifth cylindrical portion) and the cylindrical portion 96 (e.g., a sixth cylindrical portion) pass through an inside of a wall portion 71 of the housing 7. The wall portion 71 is located at a position facing the target 31 and extends so as to intersect with the X-axis direction. The cylindrical portion 95 is connected to a second end of the cylindrical portion 94 on the target 31 side of the cylindrical portion 94. The cylindrical portion 95 extends from the end of the cylindrical portion 94 to an intermediate position in the wall portion 71. The cylindrical portion 96 is connected to the cylindrical portion 95 at the intermediate position in the wall portion 71, on the target 31 side of the cylindrical portion 95. The cylindrical portion 96 extends from the end of the cylindrical portion 95 to a second end portion 9*b* of the cylindrical tube 9 on the target 31 side of the cylindrical tube 9. As illustrated in FIG. 2, the example X-ray passage hole 7*a* is provided in a wall portion 72 connected to the wall portion 71 and extending so as to intersect with the Z-axis direction. The X-ray passage hole 7*a* penetrates the wall portion 72 along the Z-axis direction.

In some examples, a relationship of "d2>d3>d1>d4>d5>d6" is established when the diameters of the six cylindrical portions 91 to 96 are d1 to d6, respectively. As an example, a first diameter d1 is 6 to 12 mm, a second diameter d2 is 10 to 14 mm, a third diameter d3 is 8 to 12 mm, a fourth diameter d4 is 4 to 6 mm, a fifth diameter d5 is 4 to 6 mm, and a sixth diameter d6 is 0.5 to 4 mm.

The cylindrical portion 91 and at least a part of the cylindrical portion 92 are positioned closer to the electron gun 2 than the part of the electron passage P that is surrounded by the pole piece 42*b* of the magnetic focusing lens 42 (gap between the yoke 42*c* and the yoke 42*d* in particular). In some examples, the cylindrical portion 91 and the at least part of the cylindrical portion 92 constitute the "part of the electron passage P that is closer to the electron gun 2 than the part of the electron passage P surrounded by the pole piece 42*b* of the magnetic focusing lens 42" (hereinafter, referred to as the "first cylindrical part"). Further, as described above, the diameter d2 of the cylindrical portion 92 is larger than the diameter d1 of the cylindrical portion 91 (d2>d1). Accordingly, the cylindrical portion 92 is larger in diameter than the cylindrical portion 91 adjacent to the electron gun 2 side. In some examples, at the first cylindrical part, at least a part of the cylindrical portion 92 constitutes a diameter-increased portion that increases in diameter toward the target 31 side of the cylindrical portion 92.

The cylindrical portion 96 includes the end portion 9*b* of the electron passage P on the target 31 side of the electron passage P. Further, the diameter d6 of the cylindrical portion 96 is smaller than the diameter d5 of the cylindrical portion 95 (d6<d5). Accordingly, the cylindrical portion 96 is smaller in diameter than the cylindrical portion 95 adjacent to the electron gun 2 side such that the cylindrical portion 96 constitutes a diameter-reduced portion that decreases in diameter toward the target 31 side of the cylindrical portion 96. In some examples, the diameter d2 of the cylindrical portion 92 is the maximum diameter of the cylindrical tube 9 that sequentially decreases from the cylindrical portion 92 toward the target 31 side of the cylindrical tube 9. Accordingly, the part of the cylindrical tube 9 including the cylindrical portions 93 to 96 can be regarded as constituting the diameter-reduced portion.

In some examples, the size of the electron beam EB is adjusted by the magnetic focusing lens 42 located downstream of the electron gun 2 and the cross-sectional shape of the electron beam EB is deformed into an elliptical shape by the magnetic quadrupole lens 43 located downstream of the magnetic focusing lens 42. Accordingly, the size of the electron beam BB and the cross-sectional shape can be adjusted independently of each other.

Figure 4A:
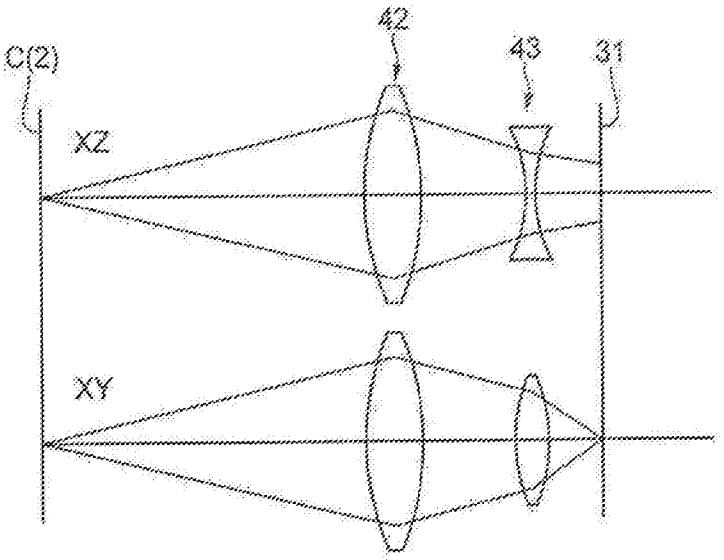
FIG. 4A is a schematic diagram of an example configuration including a magnetic focusing lens and a magnetic quadrupole lens).
Figure 4B:
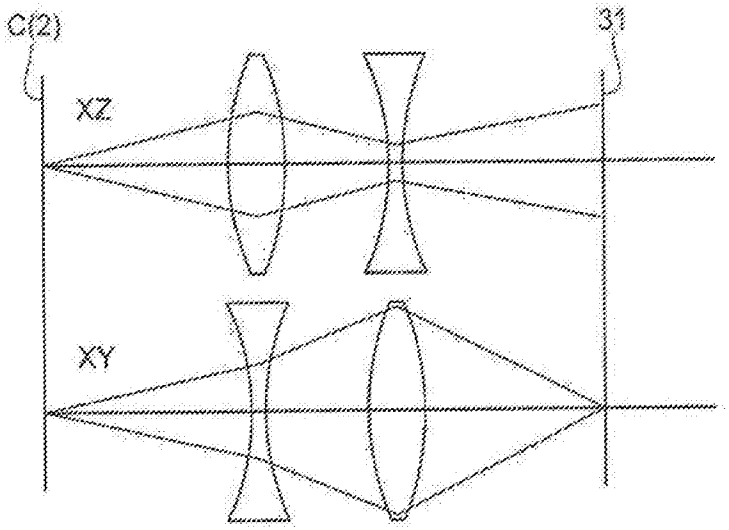
FIG. 4B is a schematic diagram of a configuration of a comparative example (doublet).

FIG. 4A illustrates a schematic diagram of an example configuration including the magnetic focusing lens 42 and the magnetic quadrupole lens 43 illustrated in FIGS. 1 and 2. FIG. 4B is a schematic diagram of a configuration of a comparative example (doublet). FIGS. 4A and 4B are diagrams schematically illustrating an example optical system acting on the electron beam EB between the cathode C (electron gun 2) and the target 31. As illustrated in the configuration of the comparative example at FIG. 4B, the aspect ratio and the size of the cross-sectional shape of the electron beam are adjusted by the combination of a two-stage magnetic quadrupole lens in which surfaces acting as concave and convex lenses are replaced with each other. In the comparative example of FIG. 4B, the lens that determines the size of the cross-sectional shape of the electron beam and the lens that determines the aspect ratio are not independent of each other. Accordingly, the size and the aspect ratio are simultaneously adjusted by combining the two-stage magnetic quadrupole lens, which can complicate the focal dimension adjustment and focal shape adjustment.

In the example configuration illustrated in FIG. 4A, in contrast, the size of the cross-sectional shape of the electron beam EB is adjusted by the upstream magnetic focusing lens 42. Accordingly, the cross-sectional shape of the electron beam EB is reduced to a certain size by the magnetic focusing lens 42. Subsequently, the aspect ratio of the cross-sectional shape of the electron beam EB is adjusted by the downstream magnetic quadrupole lens 43. In the example configuration of FIG. 4A, the lens (magnetic focusing lens 42) that determines the size of the cross-sectional shape of the electron beam EB and the lens (magnetic quadrupole lens 43) that determines the aspect ratio are independent of each other in this manner. Accordingly, a focal dimension adjustment and focal shape adjustment may be readily and flexibly performed.

Furthr, although the electron beam EB passing through the magnetic focusing lens 42 rotates around an axis along the X-axis direction, the cross-sectional shape of the electron beam reaching the magnetic quadrupole lens 43 through the magnetic focusing lens 42 is constant (circular) regardless of the rotation amount of the electron beam EB in the magnetic focusing lens 42 since the cross-sectional shape of the electron beam EB emitted by the electron gun 2 is circular. As a result, a cross-sectional shape F1 of the electron beam EB (cross-sectional shape along the YZ plane) in the magnetic quadrupole lens 43 can therefore be consistently and reliably formed into an elliptical shape having a major axis X1 along the Z direction and a minor axis X2 along the Y-axis direction. As a result, the size and the aspect ratio of the cross-sectional shape of the electron beam EB may be readily and flexibly adjusted.

The performance of the example X-ray generation apparatus 1 provided with the electron gun 2 and magnetic lens 4 was evaluated by conducting an experiment. During the experiment, a high voltage was applied to the electron gun 2 and the target 31 was set to the ground potential. The X-ray XR having an effective focal point dimension of "40 μm×40 μm" was obtained at a preselected output (voltage applied to the cathode C). In the case of a change in focal dimension during a 1,000-hour operation, the effective focal point dimension was readily obtained again by the electric current amount of the coil 43*d* of the magnetic quadrupole lens 43 being adjusted without a change in the operating condition on the cathode C side. In this manner, it has been confirmed that the effective focal point dimension of the X-ray XR may be readily corrected in accordance with a dynamic change by performing an adjustment of the electric current amount of the coil 43*d* with the X-ray generation apparatus 1.

Figure 5:
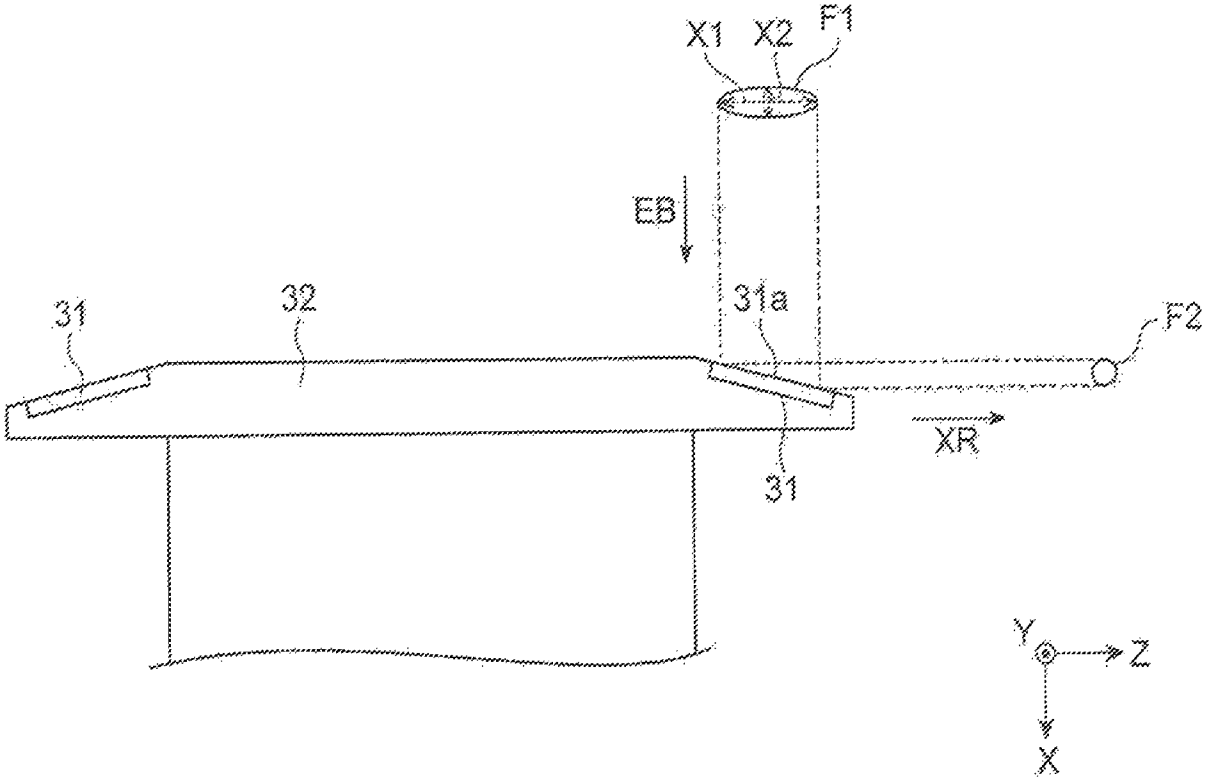
FIG. 5 is a diagram illustrating an example relationship between a cross-sectional shape of an electron beam and the shape of an effective focal point of an X-ray.

In some examples, as illustrated in FIG. 5, the target 31 has an electron incident surface 31*a* on which the electron beam EB is incident. The electron incident surface 31*a* is inclined with respect to the X-axis direction and the Z-axis direction. Further, the cross-sectional shape F1 (that is, the ratio between the major axis X1 and the minor axis X2) of the electron beam EB subsequent to the deformation into the elliptical shape by the magnetic quadrupole lens 43 and the inclination angle of the electron incident surface 31*a* with respect to the X-axis direction und the Y-axis direction are adjusted such that a focal shape F2 of the X-ray XR viewed from the extraction direction of the X-ray XR (Z-axis direction) is substantially circular. In some examples, the shape of the focal point (effective focal point) of the extracted X-ray XR can be made substantially circular by adjusting the forming condition of the magnetic quadrupole lens 43 (aspect ratio) and the inclination angle of the electron incident surface 31*a* of the target 31. As a result, an inspection image may be obtained during, for example, an X-ray inspection using the X-ray XR generated by the X-ray generation apparatus 1.

In some examples, as illustrated in FIG. 2, the length of the magnetic focusing lens 42 along the X-axis direction exceeds the length of the magnetic quadrupole lens 43 along the X-axis direction. Here, "length of the magnetic focusing lens 42 along the X-axis direction" means the total length of the yoke 42*c* surrounding the coil 42*a*. In some examples, the number of turns of the coil 42*a* of the magnetic focusing lens 42 is easily ensured. As a result, the electron beam EB may be focused by generating a relatively large magnetic field in the magnetic focusing lens 42, in order to achieve an increase in reduction ratio. Further, the distance from the electron gun 2 to the center of the lens constituted by the magnetic focusing lens 42 (part where the pole piece 42*b* is provided) may be increased in order to reduce the size of the electron beam EB incident on the electron incident surface 31*a* of the target 31.

Further, the inner diameter D of the pole piece 42*b* of the magnetic focusing lens 42 exceeds the inner diameter d of the magnetic quadrupole lens 43 (see FIG. 3). In some examples, the spherical aberration of the lens constituted by the magnetic focusing lens 42 may be reduced by making the inner diameter D of the pole piece 42*b* of the magnetic focusing lens 42 relatively large. In addition, the number of turns of the coil 43*d* in the magnetic quadrupole lens 43 may be reduced, and the amount of electric current flowing through the coil 43*d* may be reduced, by making the inner diameter d of the magnetic quadrupole lens 43 relatively small. As a result, the amount of heat generation in the magnetic quadrupole lens 43 can be reduced.

Further the X-ray generation apparatus 1 is provided with the cylindrical tube 9 extending along the X-axis direction and forming the electron passage P through which the electron beam BB passes. Further, the magnetic focusing lens 42 and the magnetic quadrupole lens 43 are directly or indirectly connected to the cylindrical tube 9. In some examples, the magnetic focusing lens 42 and the magnetic quadrupole lens 43 can be disposed or attached with respect to the cylindrical tube 9 as a reference, and thus the central axes of the magnetic focusing lens 42 and the magnetic quadrupole lens 43 can be coaxially disposed with high precision. As a result, a possible distortion of the profile (cross-sectional shape) of the electron beam EB way be prevented subsequent to passage through the magnetic focusing lens 42 and the magnetic quadrupole lens 43.

Further, the X-ray generation apparatus 1 is provided with the deflection coil 41. In some examples, the angular deviation generated between the emission axis of the electron beam EB emitted from the electron gun 2 and the central axis of the magnetic focusing lens 42 and the magnetic quadrupole lens 43 may be corrected. In addition, the deflection coil 41 is located between the electron gun 2 and the magnetic focusing lens 42. In some examples, the traveling direction of the electron beam EB may be adjusted before the electron beam EB passes through the magnetic focusing lens 42 and the magnetic quadrupole lens 43. As a result, the cross-sectional shape of the electron beam EB incident on the target 31 may be maintained it an intended elliptical shape.

The electron passage P that extends between the housing 6 accommodating the cathode C (electron gun 2) and the housing 7 accommodating the target 31 is formed in the X-ray generation apparatus 1. Further, the part including the end portion of the electron passage P on the target 31 side (end portion 9*b* of the cylindrical tube 9) is reduced in diameter toward the target 31 side of the cylindrical tube 9. In some examples, the cylindrical portion 96 (or the cylindrical portions 93 to 96) constitutes the diameter-reduced portion decreasing in diameter toward the target 31 side of the cylindrical portion 96. As a result, fewer reflected electrons which result from the electron beam EB being incident on the target 31 in the housing 7 may reach the inside of the housing 6 via the electron passage P. Accordingly, a deterioration of the cathode C attributable to the electrons reflected from the target 31 may be suppressed or prevented. The reflected electrons are electrons of the electron beam E incident on the target 31 that are reflected without being absorbed by the target 31.

Gas may be generated by the electron gun 2 when the electron beam EB is emitted by the cathode C. The gas may remain in a space in which the cathode C is accommodated. Additionally, gas (e.g., gas byproducts, such as $H_2$, $H_2O$, $N_2$, CO, $C_2$, $CH_4$, Ar) may be generated in the housing 7 due to a collision of the electron beam ED with the target 31, which may also result in electrons being reflected from the surface of the target 31. In some examples, the inlet of the electron passage P on the target 31 side of the cylindrical tube 9 (that is, the end portion 9*b*) is narrow, and thus less gas is auctioned into the housing 6 side (that is, the internal space S1) via the electron passage P and less gas is discharged from the exhaust flow path E1 provided in the housing 6. Accordingly, the housing 7 itself is provided with a discharge path for the gas (the exhaust flow path E2) in the X-ray generation apparatus 1. As a result, a deterioration of the cathode C attributable to the reflected electrons may be suppressed or prevented while appropriately evacuating each of the housings 6 and 7.

Further, the part of the magnetic focusing lens 42 (first cylindrical part) that is closer to the electron gun 2 side than the part of the electron passage P surrounded by the pole piece 42*b* has the diameter-increased portion (at least a part of the cylindrical portion 92) increasing in diameter toward the target 31 side of the cylindrical portion 92. In some examples, a movement of the reflected electrons to the cathode C side via the electron passage P may be suppressed by means of the diameter-increased portion increasing in diameter toward the target 31 side of the cylindrical portion 92 (that is, the part decreasing in diameter toward the cathode C side) even when the reflected electrons have entered the electron passage P from the end portion 9*b* of the electron passage P on the target 31 side. In addition, it is possible to effectively suppress a collision between the electron beam EB heading for the target 31 and the inner wall of the electron passage P (inner surface of the cylindrical tube 9).

Further, from the electron gun 2 side of the cylindrical tube 9 toward the target 31 side of the cylindrical tube 9, the diameter-increased portion includes a part (that is, the boundary part between the cylindrical portion 91 and the cylindrical portion 92) discontinuously changing from a part (that is, the cylindrical portion 91) having the diameter d1 (first diameter) to a part (that is, the cylindrical portion 92) having the diameter d2 (second diameter) larger than the diameter d1. In some examples, the diameter of the cylindrical tube 9 changes in a stepped manner at the boundary part between the cylindrical portion 91 and the cylindrical portion 92. The boundary part 9*c* may be formed by an annular wall having the diameter d1 as an inner diameter and the diameter d2 as an outer diameter is formed (see FIG. 2). In some examples, the reflected electrons may be caused to collide with the boundary part 9*c* even when the reflected electrons traveling from the target 31 side to the electron gun 2 side through the electron passage P are present. As a result, a movement of the reflected electrons to the cathode C side can be more effectively suppressed or prevented.

Further, the diameter of the part of the electron passage P that is surrounded by the pole piece 42*b* of the magnetic focusing lens 42 (diameter d2 of the cylindrical portion 92) is equal to or larger than the diameter of the other part of the electron passage P. Accordingly, the diameter of the electron passage P is maximized at the part surrounded by the pole piece 42*b* of the magnetic focusing lens 42. In some examples, a collision between the electron beam EB heading for the target 31 and the inner wall of the electron passage P (inner surface of the cylindrical tube 9) can be effectively suppressed by the diameter of the part where an increase in the spread of the electron beam EB emitted from the electron gun 2 occurs (that is, the part surrounded by the pole piece 42*b*) being equal to or larger than the diameter of the other part.

Further, the exhaust flow path E1 and the exhaust flow path E2 communicate (e.g., are fluidly coupled) with each other. Additionally, the exhaust unit 5 evacuates the housing 6 via the exhaust flow path E1 and evacuates the housing 7 via the exhaust flow path E2. In some examples, both the internal space S1 in the housing 6 and the internal space S2 in the housing 7 can be evacuated by the common exhaust unit 5, and thus the X-ray generation apparatus 1 can be reduced in size.

It is to be understood that not all aspects, advantages and features described herein may necessarily be achieved by, or included in, any one particular example. Indeed, having described and illustrated various examples herein, it should be apparent that other examples, including those with different materials and shapes, may be modified in arrangement and detail.

For example, the deflection coil 41 described herein may be omitted when the emission axis of the electron beam EB from the electron gun 2 and the central axis of the magnetic focusing lens 42 are aligned with high precision. In addition, the deflection coil 41 may be located between the magnetic focusing lens 42 and the magnetic quadrupole lens 43 or may be located between the magnetic quadrupole lens 43 and the target 31.

The shape of the electron passage P (cylindrical tube 9) may have a single diameter over the entire region. In addition, the electron passage P may be formed by the single cylindrical tube 9. In other examples, the cylindrical tube 9 may be provided only in the housing 6 and the electron passage P passing through the housing 7 may be formed by a through hole provided in the wall portion 71 of the housing 7. In addition, through holes in the tube member 10, the housing 44, and the housing 7 may constitute the electron passage P without the cylindrical tube 9 being separately provided.

Figure 6:
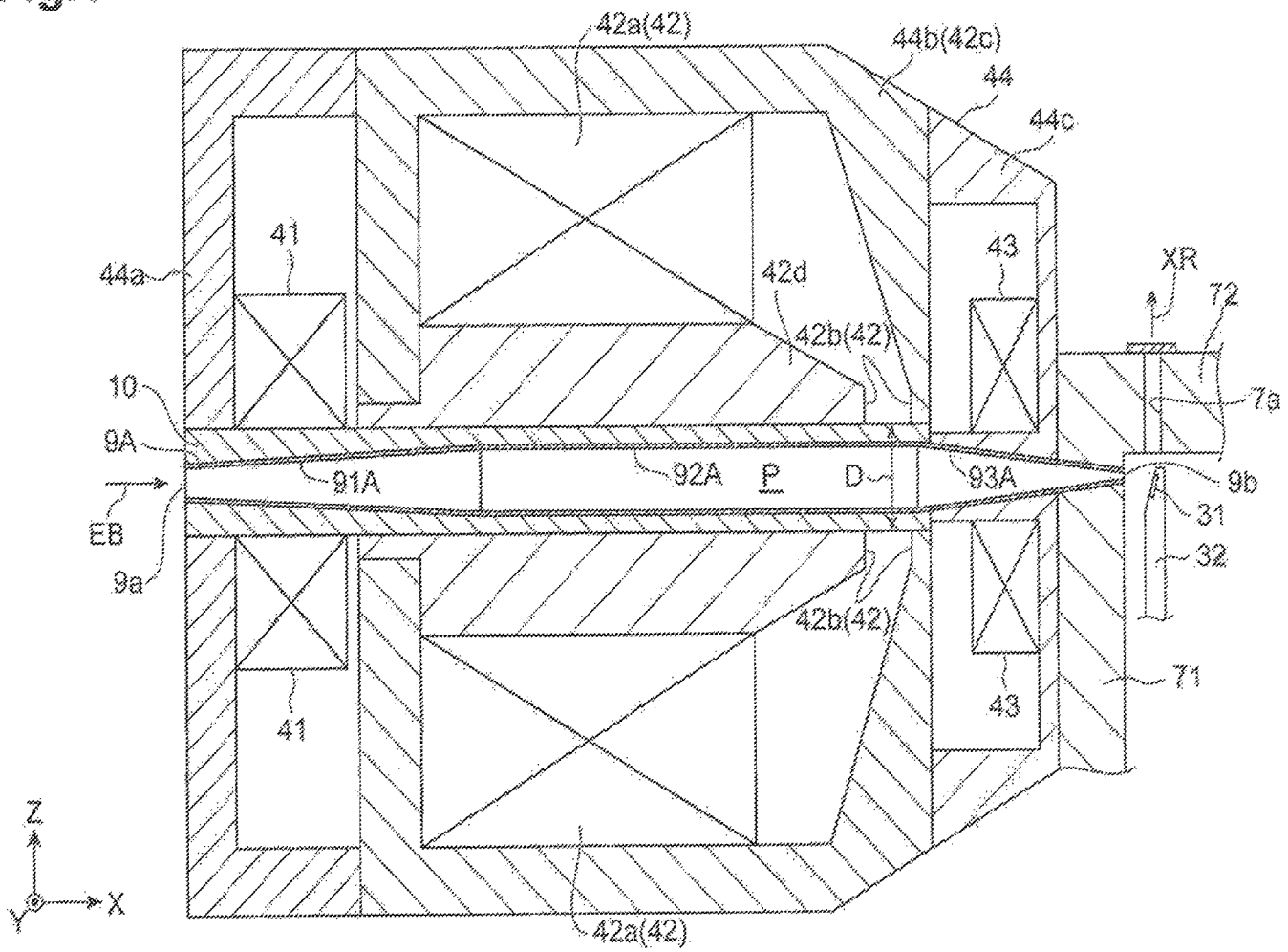
FIG. 6 is a diagram illustrating an example cylindrical tube.

An example cylindrical tube (cylindrical tube 9A) is illustrated in FIG. 6. In some examples, the cylindrical tube 9A differs from the cylindrical tube 9 illustrated in FIG. 2 in that the cylindrical tube 9A has cylindrical portions 91A to 93A instead of the cylindrical portions 91 to 96. The cylindrical portion 91A extends from the end portion 9*a* of the cylindrical tube 9 to the position surrounded by a portion of the coil 42*a* on the electron gun 2 side. The cylindrical portion 91A has a tapered shape. For example, the diameter of the cylindrical portion 91A gradually increases from the diameter d1 to the diameter d2 from the end portion 9*a* toward the target 31 side of the cylindrical portion 91A. The cylindrical portion 92A extends from the end portion of the cylindrical portion 91A on the target 31 side of the cylindrical portion 91A to a position slightly closer to the target 31 than the pole piece 42*b*. The cylindrical portion 92A has a constant diameter (the diameter 42). The cylindrical portion 93A extends from the end portion of the cylindrical portion 92A on the target 31 side of the cylindrical portion 92A to the end portion 9*b* of the cylindrical tube 9. The cylindrical portion 93A has a tapered shape. For example, the diameter of the cylindrical portion 93A gradually decreases from the diameter d2 to the diameter d6 from the end portion of the cylindrical portion 92A toward the target 31 side of the cylindrical portion 93A. In the cylindrical tube 9A, the cylindrical portion 91A corresponds to a diameter-increased portion and the cylindrical portion 93A corresponds to a diameter-reduced portion.

Figure 7:
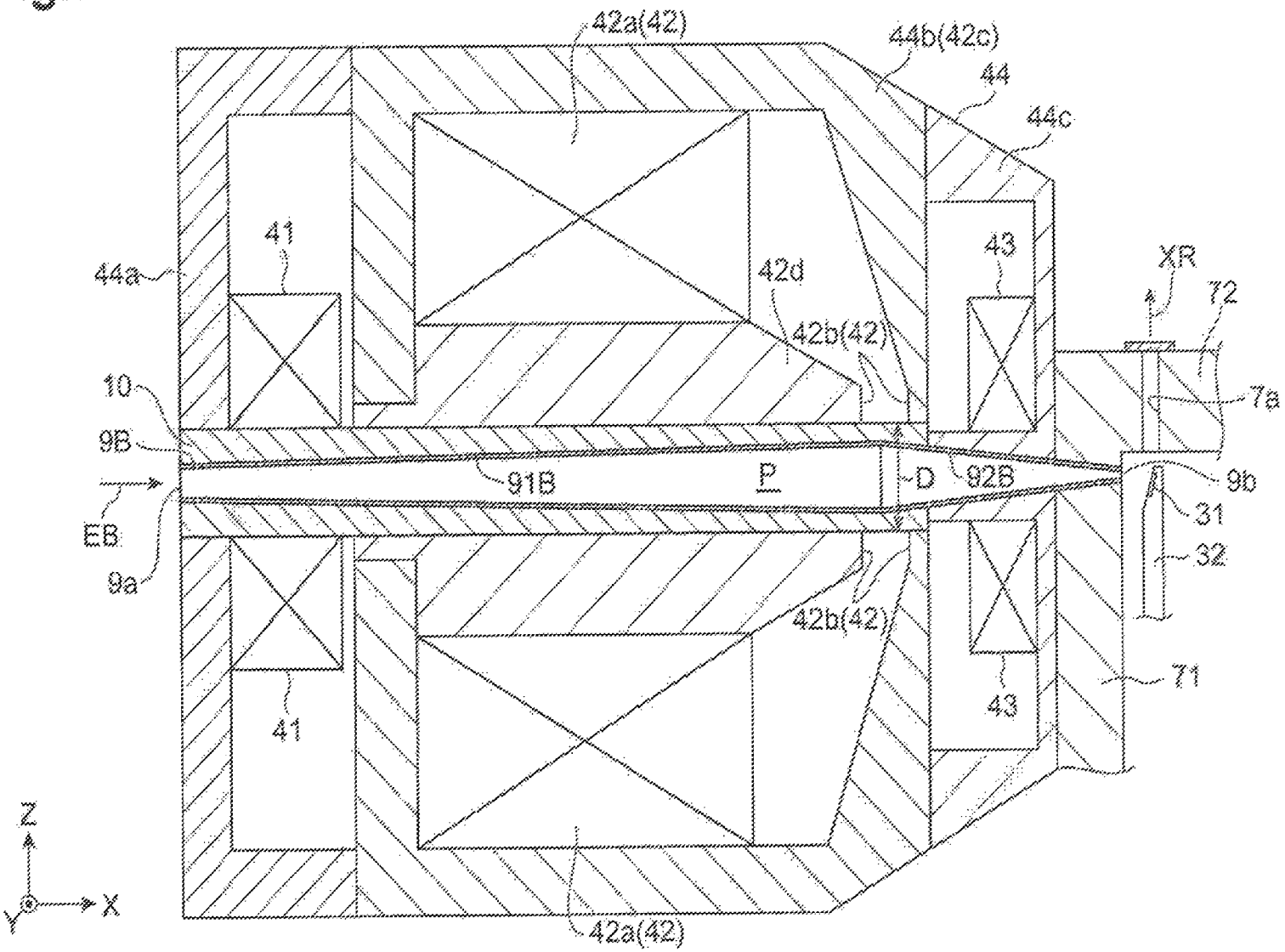
FIG. 7 is a diagram illustrating another example cylindrical tube.

Another example cylindrical tube (cylindrical tube 9B) is illustrated in FIG. 7. In some examples, the cylindrical tube 9B differs from the cylindrical tube 9 illustrated in FIG. 2 in that the cylindrical tube 9B has cylindrical portions 918 and 92B instead of the cylindrical portions 91 to 96. The cylindrical portion 91B extends from the end portion 9*a* of the cylindrical tube 9 to the position surrounded by the pole piece 42*b*. The cylindrical portion 91B has a tapered shape. For example, the diameter of the cylindrical portion 91B gradually increases from the diameter d1 to the diameter d2 from the end portion 9*a* toward the target 31 side of the cylindrical portion 91B. The cylindrical portion 92B extends from the end portion of the cylindrical portion 91B on the target 31 side to the end portion 9*b* of the cylindrical tube 9. The cylindrical portion 92B has a tapered shape. In some examples, the diameter of the cylindrical portion 92B gradually decreases from the diameter d2 to the diameter d6 from the end portion of the cylindrical portion 91B toward the target 31 side of the cylindrical portion 92A. In the cylindrical tube 9B, the cylindrical portion 91B corresponds to a diameter-increased portion and the cylindrical portion 92B corresponds to a diameter-reduced portion.

In some examples, each of the diameter-reduced portion and the diameter-increased portion of the cylindrical tube (electron passage) may have a tapered shape, as in the example cylindrical tubes 9A and 9B, instead of a stepped (discontinuous) shape as in the example cylindrical tube 9. In addition, a tapered part may constitute the cylindrical tube alone as in the cylindrical tube 9B. In addition, the cylindrical tube may have both a part where the diameter changes in a stepped manner and a part where the diameter changes in a tapered shape. For example, the diameter-reduced portion may be formed in a stepped manner as in the cylindrical tube 9 with the diameter-increased portion formed in a tapered shape as in the cylindrical tube 9A.

Further, the target may not be a rotary anode. In some examples, the target may be configured not to rotate and the electron beam EB may be configured to be incident at the same position on the target at all times. When the target is a rotary anode, local load to the target by the electron beam EB can be reduced. As a result, the amount of the electron beam EB and the dose of the X-ray XR emitted from the target may be increased.

In some examples, the electron gun 2 may be configured to emit the electron beam EB having a circular cross-sectional shape. In other examples, the electron gun 2 may be configured to emit an electron beam having anon-circular cross-sectional shape.

What is claimed is:

1. An X-ray generation apparatus comprising:

an electron gun configured to emit an electron beam having a circular cross-sectional shape;

a magnetic focusing lens located downstream of the electron gun and configured to focus the electron beam while rotating the electron beam around an axis along a first direction;

a magnetic quadrupole lens located downstream of the magnetic focusing lens and configured to deform the circular cross-sectional shape of the electron beam into an elliptical cross-sectional shape having a major axis along a second direction orthogonal to the first direction and a minor axis along a third direction that is orthogonal to both the first direction and the second direction;

a tubular portion extending along the first direction and forming an electron passage through which the electron beam passes, wherein a first inner diameter of the tubular portion surrounded by and spaced apart from the magnetic focusing lens is larger than a second inner diameter of the tubular portion surrounded by and spaced apart from the magnetic quadrupole lens; and a target located downstream of the magnetic quadrupole lens and configured to emit an X-ray in response to an incidence of the electron beam on the target.

2. The X-ray generation apparatus according to claim 1, wherein the target has an electron incident surface on which the electron beam is incident, the electron incident surface is inclined with respect to the first direction and the second direction, and a ratio between the major and minor axes of the electron beam subsequent to the deformation into the elliptical cross-sectional shape by the magnetic quadrupole lens and an inclination angle of the electron incident surface with respect to the first direction and the second direction determine a focal shape of the X-ray, when viewed from an extraction direction of the X-ray, that is substantially circular.

3. The X-ray generation apparatus according to claim 1, wherein a length of the magnetic focusing lens along the first direction exceeds a length of the magnetic quadrupole lens along the first direction.

4. The X-ray generation apparatus according to claim 1, wherein an inner diameter of a pole piece of the magnetic focusing lens exceeds an inner diameter of the magnetic quadrupole lens.

5. The X-ray generation apparatus according to claim 1, further comprising a deflection coil configured to adjust a traveling direction of the electron beam.

6. The X-ray generation apparatus according to claim 5, wherein the deflection coil is located between the electron gun and the magnetic focusing lens, and wherein a third diameter of the tubular portion surrounded by the deflection coil is smaller than the first diameter.

7. The X-ray generation apparatus according to claim 6, wherein the traveling direction of the electron beam is adjusted by the deflection coil to correct an angular deviation between the axis of the electron beam in the first direction and a central axis of an electron passage that passes through both the magnetic focusing lens and the magnetic quadrupole lens.

8. The X-ray generation apparatus according to claim 7, wherein the traveling direction of the electron beam is additionally adjusted by a second deflection coil located between the electron gun and the magnetic focusing lens to correct a lateral offset between the axis of the electron beam and the central axis of the electron passage.

9. The X-ray generation apparatus according to claim 1, wherein an end of the tubular portion directed toward the target includes a third inner diameter that is smaller than the second inner diameter.

10. An X-ray generation apparatus, comprising:

means for emitting an electron beam having a circular cross-sectional shape;

means for focusing the electron beam while rotating the electron beam around a rotational axis;

means for deforming the circular cross-sectional shape of the electron beam into an elliptical cross-sectional shape, wherein the elliptical cross-sectional shape has a major axis that is orthogonal to the rotational axis and a minor axis that is orthogonal to both the rotational axis and the major axis;

means for transmitting the electron beam along the rotational axis, wherein a first inner diameter of the means for transmitting surrounded by the means for focusing is larger than a second inner diameter of the means for transmitting surrounded by the means for deforming, and wherein an end portion of the means for transmitting directed toward a target of the electron beam includes a third inner diameter that is smaller than the second inner diameter; and means for emitting an X-ray in response to receiving, at the target, the electron beam having the elliptical cross-sectional shape.

11. The X-ray generation apparatus according to claim 10, further comprising means for adjusting a traveling direction of the electron beam, wherein the means for adjusting is located between the means for emitting the electron beam and the means for focusing in a traveling direction of the electron beam, and wherein a fourth inner diameter of the means for transmitting surrounded by the means for adjusting is smaller than the first inner diameter.

12. The X-ray generation apparatus according to claim 11, wherein the means for focusing the electron beam includes a first magnetic lens and the means for deforming the cross-sectional shape of the electron beam includes a second magnetic lens, and wherein the means for adjusting comprises:

means for correcting an angular deviation between the rotational axis of the electron beam and a central axis that passes through both the first magnetic lens and the second magnetic lens; and means for correcting a lateral offset between the rotational axis of the electron beam and the central axis.

13. The X-ray generation apparatus according to claim 10, wherein the means for emitting the X-ray has an electron incident surface that is inclined with respect to both the major axis and the minor axis, the apparatus further comprises means for adjusting an axial ratio between the major axis and the minor axis of the electron beam subsequent to deforming the circular cross-sectional shape of the electron beam into the elliptical cross-sectional shape, and a combination of the axial ratio and an inclination angle of the electron incident surface with respect to the major axis and the minor axis determines a focal shape of the X-ray that, when viewed from an extraction direction of the X-ray, is substantially circular.

14. A method of generating an X-ray, comprising:

emitting an electron beam having a circular cross-sectional shape;

focusing, by a first magnetic lens, the electron beam having the circular cross-sectional shape while rotating the electron beam around a rotational axis;

deforming, by a second magnetic lens, the circular cross-sectional shape of the electron beam into an elliptical cross-sectional shape, wherein the elliptical cross-sectional shape has a major axis that is orthogonal to the rotational axis and a minor axis that is orthogonal to both the rotational axis and the major axis;

transmitting the electron beam through a tubular portion extending along the rotational axis, wherein a first inner diameter of the tubular portion surrounded by the first magnetic lens is larger than a second inner diameter of the tubular portion surrounded by the second magnetic lens, and wherein an end of the tubular portion directed toward a target of the electron beam includes a third inner diameter that is smaller than the second inner diameter; and emitting an X-ray in response to receiving, at the target, the electron beam having the elliptical cross-sectional shape.

15. The method according to claim 14, wherein the second magnetic lens comprises a magnetic quadrupole lens.

16. The method according to claim 15, wherein the magnetic quadrupole lens deforms the circular cross-sectional shape of the electron beam into the elliptical cross-sectional shape after the electron beam having the circular cross-sectional shape is focused by the first magnetic lens.

17. The method according to claim 14, further comprising adjusting a traveling direction of the electron beam having the circular cross-sectional shape before the electron beam is focused by the first magnetic lens.

18. The method according to claim 17, wherein the traveling direction of the electron beam is adjusted by a deflection coil to correct an angular deviation or a lateral offset between the rotational axis of the electron beam and a central axis that passes through both the first magnetic lens and the second magnetic lens.

19. The method according to claim 18, wherein a fourth inner diameter of the tubular portion surrounded by the deflection coil is smaller than the first inner diameter of the tubular portion that passes through the first magnetic lens.

20. The method according to claim 14, wherein the target has an electron incident surface that is inclined with respect to both the major axis and the minor axis, the method further comprises adjusting an axial ratio between the major axis and the minor axis of the electron beam subsequent to deforming the circular cross-sectional shape of the electron beam into the elliptical cross-sectional shape, and a combination of the axial ratio and an inclination angle of the electron incident surface with respect to the major axis and the minor axis determines a focal shape of the X-ray that, when viewed from an extraction direction of the X-ray, is substantially circular.

* * * * *